US006493907B2

(12) United States Patent
Engstrom et al.

(10) Patent No.: US 6,493,907 B2
(45) Date of Patent: Dec. 17, 2002

(54) WIRE TERMINAL FASTENER AND METHOD

(75) Inventors: Ron Engstrom, Princeton, MN (US); John Franey, Roseville, MN (US); Dan Lochner, Rochester, MN (US); Jeff Louwagle, Minnetonka, MN (US); Kevin Mangle, Maple Grove, MN (US); Barry Monson, Maple Lake, MN (US); Brad Terlson, Maple Grove, MN (US); Jim Thoreson, Brooklyn Park, MN (US); Mike Willis, Plymouth, MN (US)

(73) Assignee: Honeywell International Inc., Morristown, NJ (US)

( * ) Notice: Subject to any disclaimer, the term of this patent is extended or adjusted under 35 U.S.C. 154(b) by 28 days.

(21) Appl. No.: 09/759,891

(22) Filed: Jan. 12, 2001

(65) Prior Publication Data

US 2002/0092134 A1 Jul. 18, 2002

(51) Int. Cl.[7] ..... B65D 63/10; H01R 11/00

(52) U.S. Cl. ..... 24/28; 24/26; 24/27; 24/29; 206/343; 439/502

(58) Field of Search ..... 24/28, 27, 26, 24/21, 22, 29; 439/502; 206/343

(56) References Cited

U.S. PATENT DOCUMENTS

| | | | | | |
|---|---|---|---|---|---|
| 117,202 | A | * | 7/1871 | Peyton | 24/28 |
| 616,552 | A | * | 12/1898 | Neely | 24/26 |
| 3,510,829 | A | * | 5/1970 | Keller | 339/156 R |
| 3,588,792 | A | * | 6/1971 | Kindell | 206/343 |
| 3,796,987 | A | * | 3/1974 | Kinkaid et al. | 339/217 |
| 3,864,008 | A | * | 2/1975 | Bakermans et al. | 339/28 |
| 4,029,936 | A | * | 6/1977 | Schweitzer | 219/267 |
| 4,152,686 | A | * | 5/1979 | Hughes | 336/192 |
| 4,313,646 | A | * | 2/1982 | Millhimes et al. | 339/156 R |
| 4,568,138 | A | * | 2/1986 | McKenzie | 339/204 |
| 4,760,632 | A | | 8/1988 | Rapp | |
| 4,760,634 | A | | 8/1988 | Rapp | |
| 4,831,704 | A | | 5/1989 | Rapp | |
| 4,831,711 | A | | 5/1989 | Rapp | |
| 5,025,350 | A | * | 6/1991 | Tienken | 362/61 |

OTHER PUBLICATIONS

Autosplice Inc. product brochure, "Crimping Systems Technology & Applications"; 4 Pages, No Date is Given.

* cited by examiner

*Primary Examiner*—Victor Sakran

(57) ABSTRACT

A wire fastener for use in providing a strong, slip resistant structure in which the fastener includes a hump which the wire passes over and includes ears on either side of the hump which are crimped over the wire on both sides of the hump to cause the wire to bend in a double "s" shape over the hump.

16 Claims, 1 Drawing Sheet

WIRE TERMINAL FASTENER AND METHOD

BACKGROUND OF THE INVENTION

1. Field of the Invention

The present invention is in the field of wire fasteners and more particularly to terminal fasteners for use with non-malleable wire.

2. Description of the Prior Art

Many wire fasteners are available in the prior art. The majority of prior art fasteners are for malleable wire such as copper. Some such fasteners include a pair of foldable members which are pressed down around the wire to hold it in place and may include a terminal member such as a loop which may be positioned around a binding post, bolt or other such device connected to a circuit to which connection is desired to be made. Stainless steel fasteners are often preferred to provide a strong long lasting and corrosion resistant fastener that makes good electrical contact. Generally, the wire is caused to deform around a portion of the stainless steel fastener to prevent slippage.

Such fasteners encounter difficulties when they are applied to a non-malleable wire such as tungsten since the non-malleable wire does not deform to provide a non-slipping connection to the fastener. Thus, when it is required that the wire be able to withstand axial forces or pull, the wire can slip out of the fastener and electric contact will be broken. Techniques such as welding are complicated and quite costly.

SUMMARY OF THE INVENTION

Although the present invention has utility for providing fasteners with various types of wire, the primary utility is intended for providing an electrical fastener for use with a non-malleable wire such as 0.008-inch tungsten, which can resist an axial pull of at least eight pounds without breaking contact. This is accomplished using simple production equipment to minimize cost and maximize ease of manufacture. Specifically, a double "S" shaped or "camel back" shaped mechanical attachment along the axis of the wire is used with the wire being crimped on either side thereof. To assure further pull resistance, the wire is passed in "camel back" fashion over a hump formed by a folded-over spring member which has small burrs that grip the wire at the contact points and the wire is forced perpendicular to its length against the burrs aided by the spring force of the spring member to significantly increase the contact force of the wire against the spring member. The ears that are folded over the wire and crimped on either side of the hump are positioned relatively close to the hump to cause a tight bend in the wire around the hump and thus force it into the double "S" shape that allows the assembly to resist separation even when extremely high axial pull forces are applied. The two pairs of ears are an integral part of the terminal and located directly across from each other. In order to prevent overlapping of the ears when folded, they may be shaped with, for example, a forty-five degree angle, so that when folded and crimped, the forty-five degree edges are close but not overlapping each other. The meshing reduces the leverage distance from the captured wire to the fold of each ear which results in greater force required to lift the ears away from the terminal body thus an increase of the resistance to pulling force and improving the overall wire to terminal axial pull strength.

DETAILED DESCRIPTION

Figure 1:
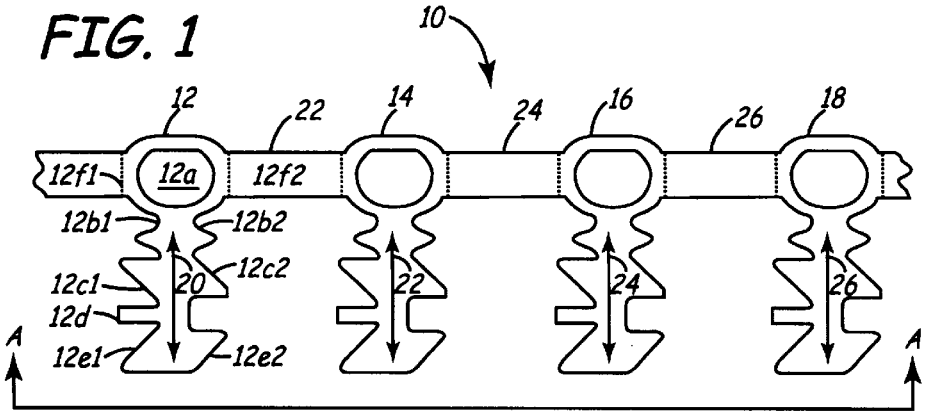
FIG. 1 shows a top view of a series of terminal blanks stamped from a sheet metal strip.

Referring to FIG. 1, a continuous strip of fasteners 10 is shown with individual fasteners 12, 14, 16 and 18 interconnected by portions 22, 24 and 26. The fasteners are shown having a length generally extending along axes shown by arrows 20, 22, 24 and 26 may be formed from half hard stainless steel stock, which may be wound for storage on a reel (not shown). It should be understood that the punch press which stamps the strip of fasteners 10 leaves tiny burrs of metal on the down side of the metal or, as shown in FIG. 1, into the plane of the drawing. These burrs aid in the holding of the wire as will be explained.

Each fastener, 12, 14, 16 and 18 includes the same elements and for simplicity, only fastener 12 will be described. Fastener 12 includes an eyelet portion 12*a*, for use in attachment to a binding post or connector to make electrical contact with a circuit (not shown). Below the eyelet portions 12*a*, oppositely disposed semi-circular cutout portions 12*b*1 and 12*b*2 are shown for use with dowel shaped members (not shown) to position or "pilot" the fasteners during their attachment to a wire. Below the cutouts 12*b*1 and 12*b*2, a first pair of ears 12*c*1 and 12*c*2 are formed with slanting edges to prevent overlap when folded as will be explained. Below the ears 12*c*1 and 12*c*2, the connector includes a tab 12*d* which will be folded over to provide a spring like hump to push against the wire as will be described. Finally, below the tab 12*d*, a second pair of ears 12*e*1 and 12*e*2 are formed, like the first pair of ears 12*c*1 and 12*c*2, with slanting edges to prevent overlap when folded.

The fasteners 14, 16 and 18 as well as others (not shown) are formed in the same way as fastener 12. When they are to be attached to a wire, they will be separated along dotted lines such as 12*f*1 and 12*f*2 for fastener 12 during an assembly process which would normally be performed in a straight forward assembly machine (not shown) but, for purposes of clarity, the process will be described in connection with FIGS. 2–6, for the individual fastener 12 as if performed manually.

Figure 2:
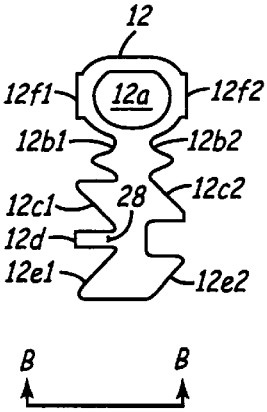
FIG. 2 shows a single fastener cut from the series of FIG. 1.
Figure 2A:
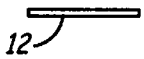
FIG. 2*a* shows a view of FIG. 2 taken along sight B—B.

In FIGS. 2 and 2*a*, the individual fastener 12 of FIG. 1 is shown separated from the others in the strip. A dotted line 28 is shown across tab 12*d* to show where a bend is to be performed.

Figure 3:
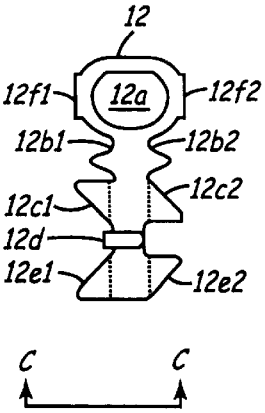
FIG. 3 shows the fastener of FIG. 2 with the spring like hump folded over.
Figure 3A:
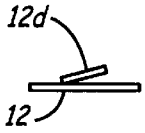
FIG. 3*a* shows a view of FIG. 3 taken along sight C—C.

In FIGS. 3 and 3*a*, the bend along line 28 of FIG. 2 has been performed resulting in tab 12*d* bending over the rest of the fastener. In FIG. 3*a*, tab 12*d* is shown angling slightly upwards and to the right as seen in FIG. 3*a*. This ramp formed by tab 12*d* provides a springiness which will be used to increase the holding power of the fastener, as will be described. Of course, a ramp is not required to provide springiness. For example, the tab could be bent in a radius so that it extended back toward the fastener. It is desirable that the tab be bent so as not come to rest against the fastener and at least some space exist between the tab and the fastener to provide springiness.

Figure 4:
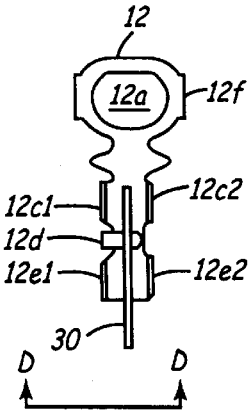
FIG. 4 shows the fastener of FIG. 3 with the ears bent up and the wire positioned for capture.
Figure 4A:
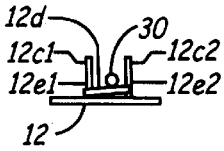
FIG. 4*a* shows a view of FIG. 4 taken along sight D—D.

In FIGS. 4 and 4*a*, the ears 12*c*1, 12*c*2, 12*e*1 and 12*e*2 are shown folded upward as best seen in FIG. 4*a*, and a wire 30 has been laid in the channel formed by the ears 12*c*1, 12*c*2, 12*e*1 and 12*e*2 and extends generally along axis 20 across the tab 12*d*.

Figure 5:
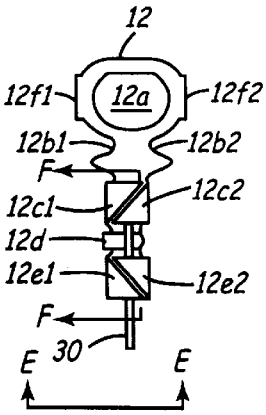
FIG. 5 shows the fastener of FIG. 4 with the ears crimped on either side of the hump to capture the wire.
Figure 5A:
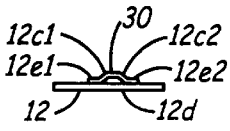
FIG. 5*a* shows a view of FIG. 5 taken along sight E—E.

In FIGS. 5 and 5*a*, the ears 12*c*1 and 12*c*2 have been crimped over the upper part of wire 30 above the hump formed by tab 12*d* and the ears 12*e*1 and 12*e*2 have been crimped over the lower part of wire 30 below the hump formed by tab 12*d*. It is seen that the crimping of ears 12*c*1, 12*c*2, 12*e*1 and 12*e*2 on either side of the hump formed by tab 12*d* forces the wire 30 into a double "S" shaped bend as will be best seen in FIG. 6.

Figure 6:
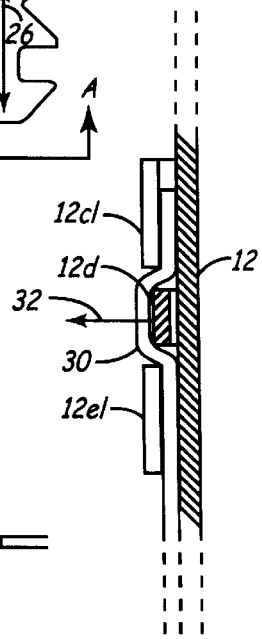
FIG. 6 shows an enlarged cross-section view of FIG. 5 taken along section F—F.
Figure 1A:
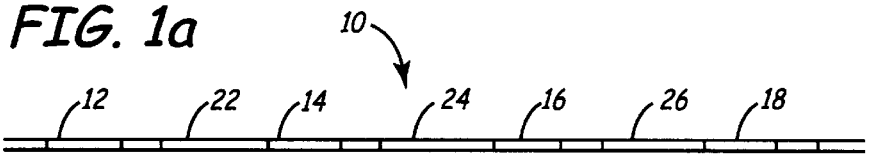
FIG. 1*a* shows a view of FIG. 1 taken along sight A—A.

FIG. 6 is enlarged for clarity and shows the fastener 12 of FIG. 5 in cross-section taken along section F—F. It is seen that the folded ears 12*c*1 and 12*e*1 are fairly close to the folded tab 12*d* so that the double "S" shaped hump is rather tight to increase the holding power provided. It is also seen the tab 12*d* has been folded so that the burrs which were formed by the stamping process and which extended into the plane of the drawings, now point away from the plane of the drawings and toward wire 30 so as to tend to "dig in" and increase the grip formed between the tab 12*d* and the wire 30.

The resulting fastener is strong and easy to produce. It resists pulling forces applied between the fastener and the wire and is far simpler in construction that other fasteners presently available. It should be understood that many modifications to the apparatus and process herein described will become apparent to those having ordinary skill in the art. For example, while the wire has been described as being composed of tungsten and the fastener as being composed of stainless steel, other materials may be used. Also, while the process was described as being performed on a single fastener as if done manually, the automatic assembly of the fasteners sand the wires will be more commonly performed. Finally, while the specific shapes of the ears with forty-five degree sides and the tab of generally rectangular cross section, have been described, other shapes may be used without departing from the spirit of the invention. We therefore do not wish to be limited to the specific disclosures used in connection with describing the preferred embodiment.

It is claimed:

1. A wire fastener comprising a length of material generally extending along an axis comprising:

a tab, which is foldable over the axis to form a hump;

a first ear portion which is foldable over the axis on a first side of the hump; and, a second ear portion, which is foldable over the axis on a second side of the hump, the fastener adapted to receive a wire generally along the axis so that the wire passes over the hump and is crimped on both sides of the hump by the first and second ear portions.

2. The fastener of claim 1 wherein the hump provides a spring pressure against the wire.

3. The fastener of claim 1 wherein the tab includes burrs that can bite the wire for greater pull strength.

4. The fastener of claim 1 wherein the fastener is stamped from a strip of sheet metal.

5. The fastener of claim 4 wherein the sheet metal comprises stainless steel.

6. The fastener of claim 1 wherein the length of material includes an end shaped for connecting to a binding post.

7. The fastener of claim 6 where the end is in the form of an eyelet.

8. The fastener of claim 1 wherein the wire is non-malleable.

9. The fastener of claim 8 wherein the wire comprises tungsten.

10. A fastener having a length extending along an axis, comprising:

a tab connected to the fastener to form a hump when folded across the axis;

a wire positioned along the axis and passing over the hump; and first and second ears connected to the fastener to crimp the wire on both sides of
the hump when folded across the axis.

11. The fastener of claim 10 wherein the hump provides a spring pressure against the wire.

12. The fastener of claim 11 wherein the tab includes burrs that can bite the wire for greater pull strength.

13. The fastener of claim 10 wherein the fastener is stamped from a strip of material including stainless steel.

14. The fastener of claim 10 wherein the length of material includes an end shaped for connecting to a binding post.

15. The fastener of claim 10 wherein the wire is non-malleable.

16. The fastener of claim 15 wherein the wire comprises tungsten.

* * * * *